US007273158B1

(12) United States Patent
Dean

(10) Patent No.: US 7,273,158 B1
(45) Date of Patent: Sep. 25, 2007

(54) GOLF BALL DISPENSING AND RETRIEVING SYSTEM

(76) Inventor: Ronald G. Dean, 9725 N. Exeter Ave., Portland, OR (US) 97203

( * ) Notice: Subject to any disclaimer, the term of this patent is extended or adjusted under 35 U.S.C. 154(b) by 273 days.

(21) Appl. No.: 11/073,386

(22) Filed: Mar. 2, 2005

(51) Int. Cl.
*B65G 59/06* (2006.01)

(52) U.S. Cl. ..... 221/270; 221/307; 221/267; 221/260; 221/245

(58) Field of Classification Search ..... 221/307, 221/260, 267, 245, 270
See application file for complete search history.

(56) References Cited

U.S. PATENT DOCUMENTS

| | | | | |
|---|---|---|---|---|
| 1,940,321 | A | 12/1933 | Pagett | 273/33 |
| 3,206,067 | A | 9/1965 | Smith, Jr. et al. | 221/281 |
| 4,629,235 | A | 12/1986 | Logue | 294/19.2 |
| 4,676,397 | A | 6/1987 | Hoffmeister | 221/105 |
| 5,620,378 | A | 4/1997 | Fritz et al. | 473/282 |
| 5,675,600 | A | 10/1997 | Yamamoto et al. | 372/38 |
| 5,975,600 | A * | 11/1999 | Hwang | 221/301 |
| 6,199,926 | B1 | 3/2001 | Lemoine | 228/180.5 |
| 6,386,607 | B1 | 5/2002 | Deininger | 294/19.2 |
| 6,439,424 | B1 * | 8/2002 | Threadgill, Jr. | 221/185 |
| 6,440,007 | B1 | 8/2002 | Imahata | 473/282 |
| 6,488,593 | B2 * | 12/2002 | Imahata | 221/295 |
| 6,739,477 | B1 * | 5/2004 | Pascual | 221/199 |
| 6,760,956 | B1 * | 7/2004 | Lee et al. | 24/3.12 |
| 2002/0092862 | A1 | 7/2002 | Threadgill, Jr. | 221/283 |
| 2004/0094565 | A1 | 5/2004 | Bosanac | 221/247 |

* cited by examiner

*Primary Examiner*—Gene O. Crawford
*Assistant Examiner*—Timothy Waggoner

(57) ABSTRACT

A golf ball dispensing and retrieving system for efficiently assisting a golfer in practicing putting. The golf ball dispensing and retrieving system includes an elongated tube having a lower opening, a clamp extending from a side of the tube for removably attaching to a shaft of a putter, a retrieval member attached within the tube near the lower opening, and an ejector member movably positioned within the tube for ejecting a lower golf ball from the lower opening. A bias member is attached to the ejector member for applying a return force to the bias member.

20 Claims, 8 Drawing Sheets

GOLF BALL DISPENSING AND RETRIEVING SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to golfing practice devices and more specifically it relates to a golf ball dispensing and retrieving system for efficiently assisting a golfer in practicing putting.

2. Description of the Related Art

Any discussion of the prior art throughout the specification should in no way be considered as an admission that such prior art is widely known or forms part of common general knowledge in the field.

Conventional golf putters have been in use for years. Some golfers practice their putting by utilizing hollow plastic practice balls and use the same on artificial practice putting structures. Some golf practice equipment is designed to "kick back" the golf ball after it is shot into a cup structure.

One of the problems with conventional golf putters and golf practice equipment is that the user must have all of their practice golf balls exposed which can interfere with the practice shots. Another problem with conventional golf putters and golf practice equipment is that the user still has to bend over and physically retrieve the practice golf balls after putting the same. A further problem with conventional golf putters and golf practice equipment is that they are time consuming to utilize.

While conventional golf related devices may be suitable for the particular purpose to which they address, they are not as suitable for efficiently assisting a golfer in practicing putting. Conventional golf putters and golf practice equipment do not facilitate convenient dispensing and retrieval of golf balls for the golfer.

In these respects, the golf ball dispensing and retrieving system according to the present invention substantially departs from the conventional concepts and designs of the prior art, and in so doing provides an apparatus primarily developed for the purpose of efficiently assisting a golfer in practicing putting.

BRIEF SUMMARY OF THE INVENTION

In view of the foregoing disadvantages inherent in the known types of golf practice devices now present in the prior art, the present invention provides a new golf ball dispensing and retrieving system construction wherein the same can be utilized for efficiently assisting a golfer in practicing putting.

The general purpose of the present invention, which will be described subsequently in greater detail, is to provide a new golf ball dispensing and retrieving system that has many of the advantages of the golf practice devices mentioned heretofore and many novel features that result in a new golf ball dispensing and retrieving system which is not anticipated, rendered obvious, suggested, or even implied by any of the prior art golf practice devices, either alone or in any combination thereof.

To attain this, the present invention generally comprises an elongated tube having a lower opening, a clamp extending from a side of the tube for removably attaching to a shaft of a putter, a retrieval member attached within the tube near the lower opening, and an ejector member movably positioned within the tube for ejecting a lower golf ball from the lower opening. A bias member is attached to the ejector member for applying a return force to the bias member.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a golf ball dispensing and retrieving system that will overcome the shortcomings of the prior art devices.

A second object is to provide a golf ball dispensing and retrieving system for efficiently assisting a golfer in practicing putting.

Another object is to provide a golf ball dispensing and retrieving system that reduces the amount of time for positioning a golf ball.

An additional object is to provide a golf ball dispensing and retrieving system that allows a golfer to efficiently practice putting shots.

A further object is to provide a golf ball dispensing and retrieving system that allows a golfer to stand in one place while practicing putting.

Another object is to provide a golf ball dispensing and retrieving system that reduces the amount of bending over to position and retrieve practice golf balls.

A further object is to provide a golf ball dispensing and retrieving system that is removably attachable to various types of conventional putters.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1A:
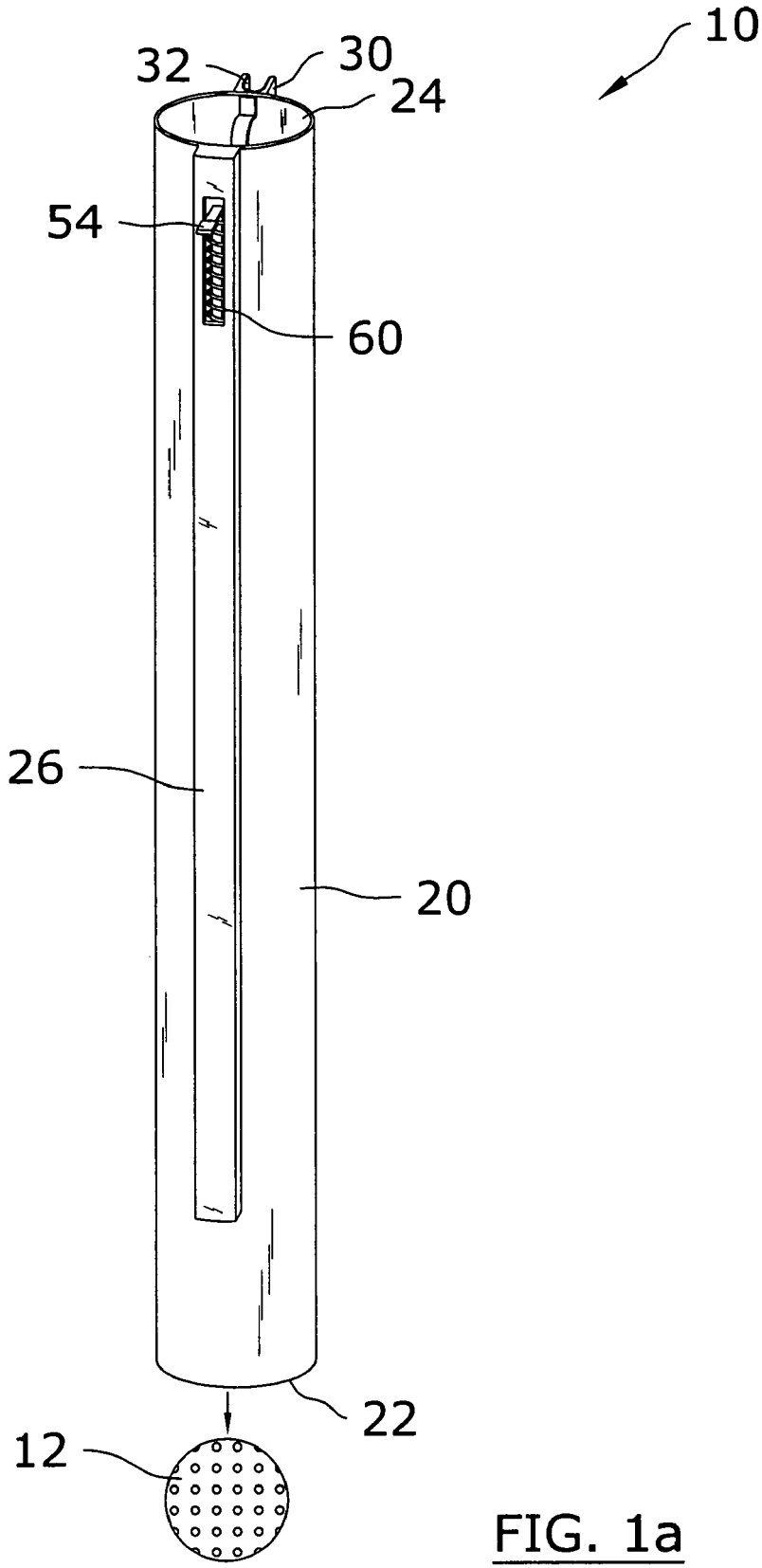
FIG. 1*a* is a front upper perspective view of the present invention positioned above a golf ball being dispensed.
Figure 1B:
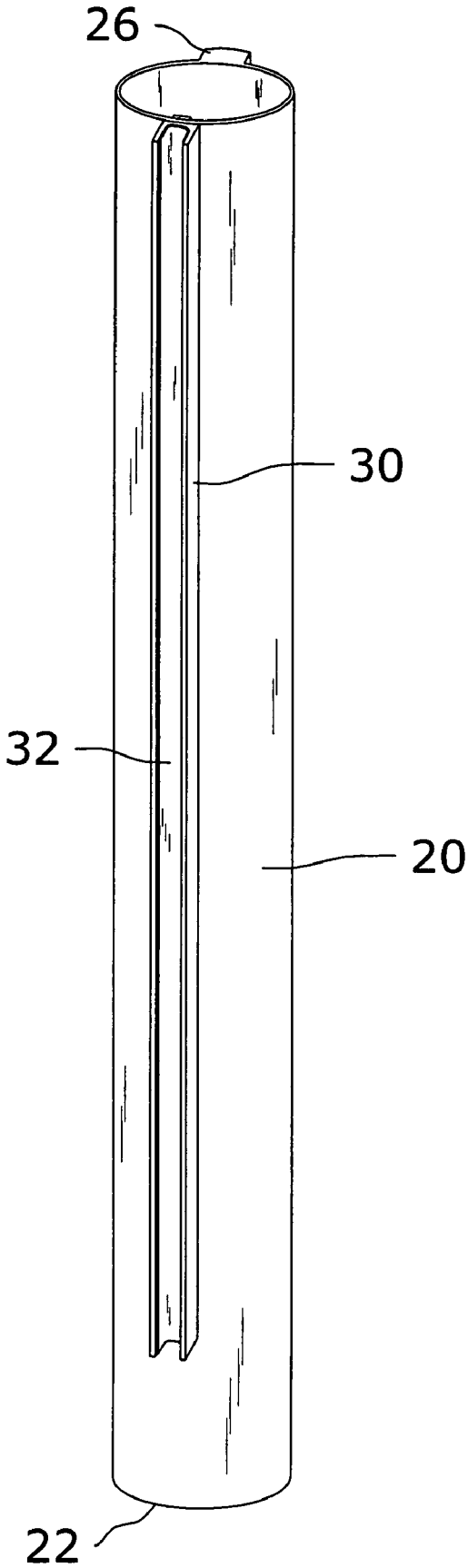
FIG. 1*b* is a rear upper perspective view of the present invention.

Turning now descriptively to the drawings, in which similar reference characters denote similar elements throughout the several views, FIGS. 1*a* through 11 illustrate a golf ball dispensing and retrieving system 10, which comprises an elongated tube 20 having a lower opening 22, a clamp 30 extending from a side of the tube 20 for removably attaching to a shaft 16 of a putter 14, a retrieval member 42 attached within the tube 20 near the lower opening 22, and an ejector member 50 movably positioned within the tube 20 for ejecting a lower golf ball 12 from the lower opening 22. A bias member 60 is attached to the ejector member 50 for applying a return force to the bias member 60.

B. Elongated Tube

Figure 4:
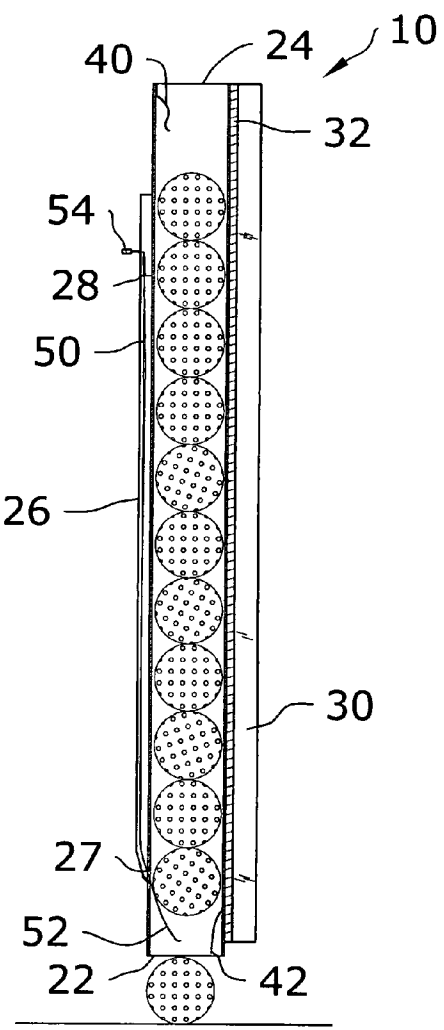
FIG. 4 is a side cutaway view of the present invention with the ejector member fully extended thereby dispensing the lowest golf ball.
Figure 3:
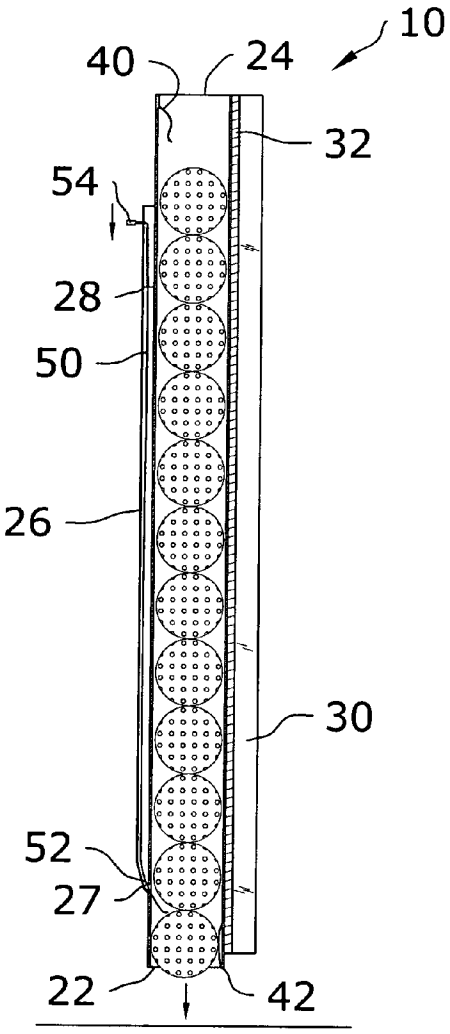
FIG. 3 is a side cutaway view of the present invention with the ejector member partially extended thereby engaging the lowest golf ball in the tube.
Figure 2:
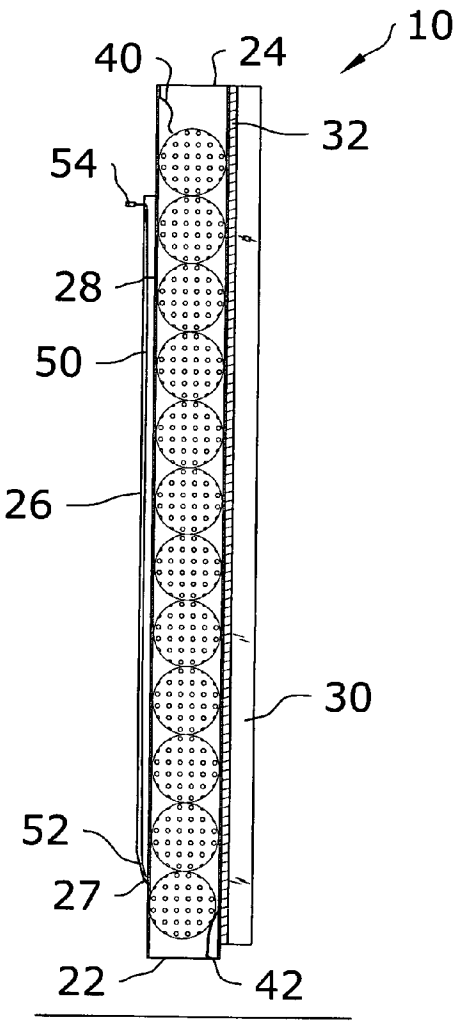
FIG. 2 is a side cutaway view of the present invention with a plurality of golf balls within the tube.

FIGS. 1*a* through 10 illustrate the elongated tube 20. The elongated tube 20 preferably has a lower opening 22, an upper opening 24 opposite of the lower opening 22 and a reservoir 21 capable of receiving a plurality of golf balls 12. The lower opening 22 and the upper opening 24 are connected to the reservoir 21 as shown in FIGS. 2 through 4 of the drawings.

The elongated tube 20 may have various cross sectional shapes such as circular, square and the like. The reservoir 21 preferably extends along a significant portion of the elongated tube 20 as illustrated in FIGS. 2 through 4 of the drawings. The reservoir 21 has a width sufficient to receive a golf ball 12. The reservoir 21 is capable of receiving various types of golf balls 12 (e.g. plastic).

C. Clamp

As shown in FIGS. 1*b* through 10, at least one clamp 30 extends from a side of the tube 20 that is designed for removably attaching to a shaft 16 of a putter 14. The clamp 30 is comprised of an elongated structure formed to snugly receive a shaft 16 of a golf club. The clamp 30 further is preferably comprised of a U-shaped or C-shaped structure for catchably engaging the shaft 16 of a conventional golf club. The clamp 30 further includes at least one magnetic strip 32 that allows for removable connection to a metal shaft 16 of a golf club.

D. Upper Stopper Member

A stopper member 40 is positioned within an upper portion of the tube 20 for preventing golf balls 12 from escaping through the upper opening 24 as best illustrated in FIGS. 2 through 4 of the drawings. The stopper member 40 preferably extends downwardly into the reservoir 21 of the tube 20 thereby allowing golf balls 12 to pass into the tube 20 from the upper opening 24 while catchably preventing golf balls 12 from exiting through the upper opening 24. The stopper member 40 is preferably comprised of a biased material such as but not limited to spring steel.

E. Lower Retrieval Member

As shown in FIGS. 2 through 4 of the drawings, a retrieval member 42 is attached within the tube 20 near the lower opening 22 for retaining the golf balls 12 within the tube 20 and preventing the golf balls 12 from accidentally exiting through the lower opening 22. The retrieval member 42 preferably extends downwardly towards the lower opening 22 and does not extend past a midpoint of the tube 20 so that golf balls 12 may enter into the lower opening 22 without obstruction. The retrieval member 42 is preferably comprised of a biased material such as but not limited to spring steel.

F. Elongated Guide Member

An elongated guide member 26 is attached to a side of the tube 20 as shown in FIGS. 1*a* and 2 through 10 of the drawings. The guide member 26 preferably has a tubular structure that slidably receives the ejector member 50. A side opening 27 extends through a lower portion of the tube 20 for receiving a portion of the ejector member 50 as shown in FIGS. 2 through 4 of the drawings. The side opening 27 is positioned above the lower opening 22 a distance sufficient for a distal end of the ejector member 50 to engage an upper portion of the lowest golf ball 12 within the tube 20 as further shown in FIGS. 2 through 4 of the drawings.

A partition member 28 is preferably positioned within the guide member 26 wherein the ejector member 50 slidably extends through the partition member 28 and wherein the bias member 60 engages the partition member 28 as shown in FIGS. 2 through 4 of the drawings. The retrieval member 42 is preferably comprised of a biased material such as but not limited to spring steel.

G. Ejector Member

The ejector member 50 is movably positioned within the elongated guide member 26 as shown in FIGS. 2 through 4 of the drawings. The ejector member 50 is preferably comprised of an elongated structure having an extended portion 52 that extends through the side opening 27 at an angle with respect to a longitudinal axis of the tube 20 for ejecting a lower golf ball 12 from the lower opening 22 as shown in FIGS. 2 through 4 of the drawings.

The ejector member 50 also preferably has a handle portion 54 opposite of the extended portion 52 for allowing a user to manually manipulate the ejector member 50. The handle portion 54 extends through a slot within the guide member 26 as shown in FIG. 1*a* of the drawings.

A bias member 60 is attached to the ejector member 50 for applying a return force to the bias member 60. The bias member 60 is preferably comprised of a compression spring that is positioned between the handle portion 54 of the ejector member 50 and the partition member 28 within the guide member 26.

H. Operation of Invention—Load and Retrieving Golf Balls

In use, the user may load a plurality of golf balls 12 into the reservoir 21 of the tube 20 either from the upper opening 24 or the lower opening 22. If using the upper opening 24 to load the present invention, the user simply inserts the golf balls 12 manually through the upper opening 24 wherein the stopper member 40 prevents the golf balls 12 from accidentally being released through the upper opening 24. The user may insert as many golf balls 12 as desired or available until the tube 20 is filled.

Figure 5:
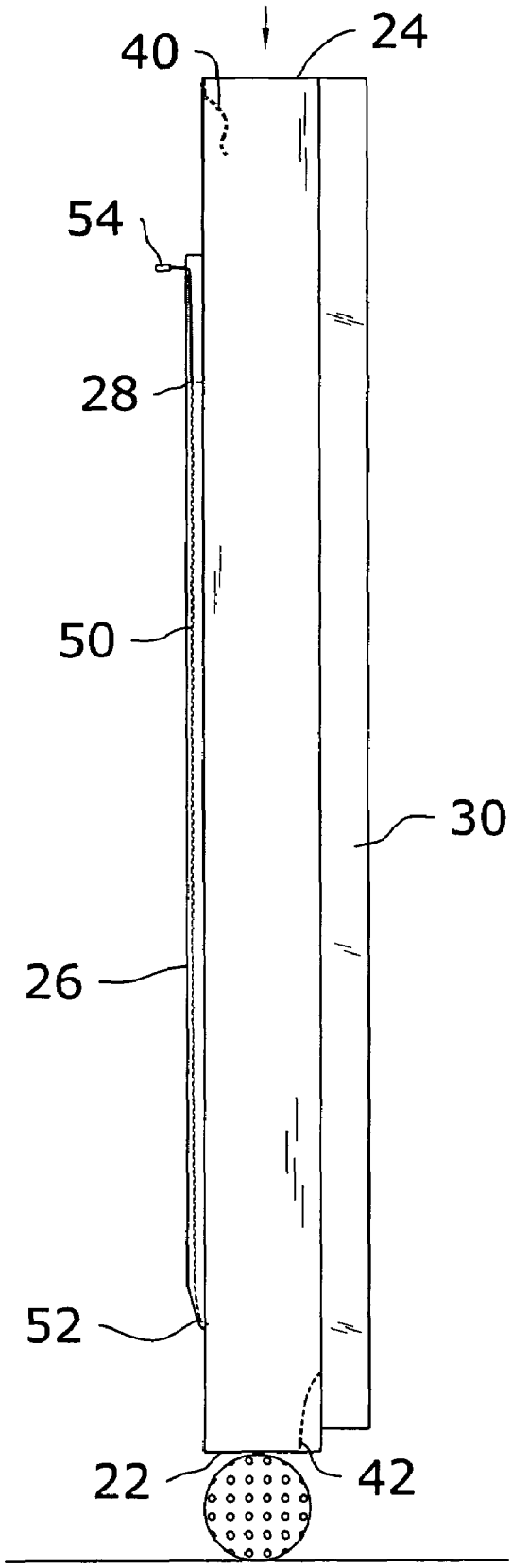
FIG. 5 is a side view of the present invention positioned above a golf ball to be retrieved.
Figure 6:
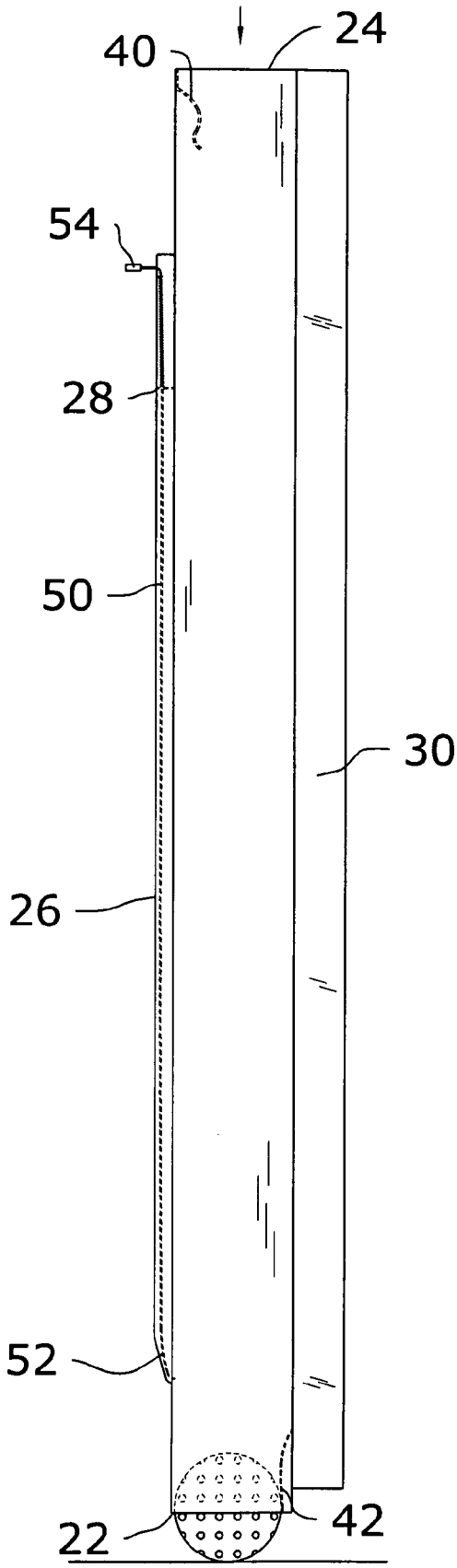
FIG. 6 is a side view of the present invention with the golf ball partially received within the lower opening of the tube.
Figure 7:
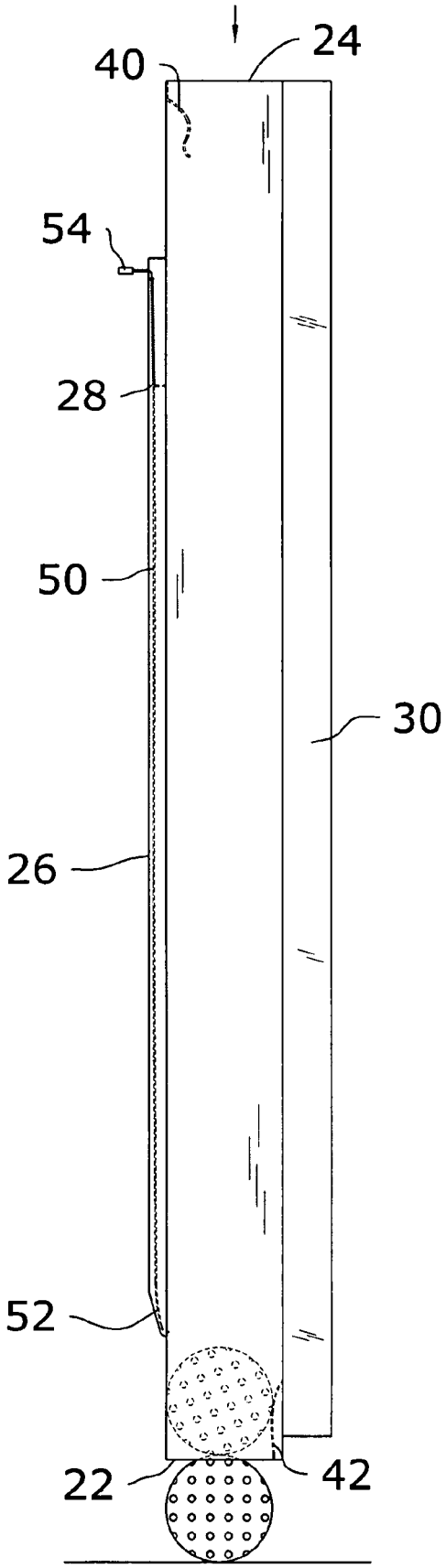
FIG. 7 is a side view of the present invention with a second golf ball positioned beneath the first golf ball retrieved.
Figure 8:
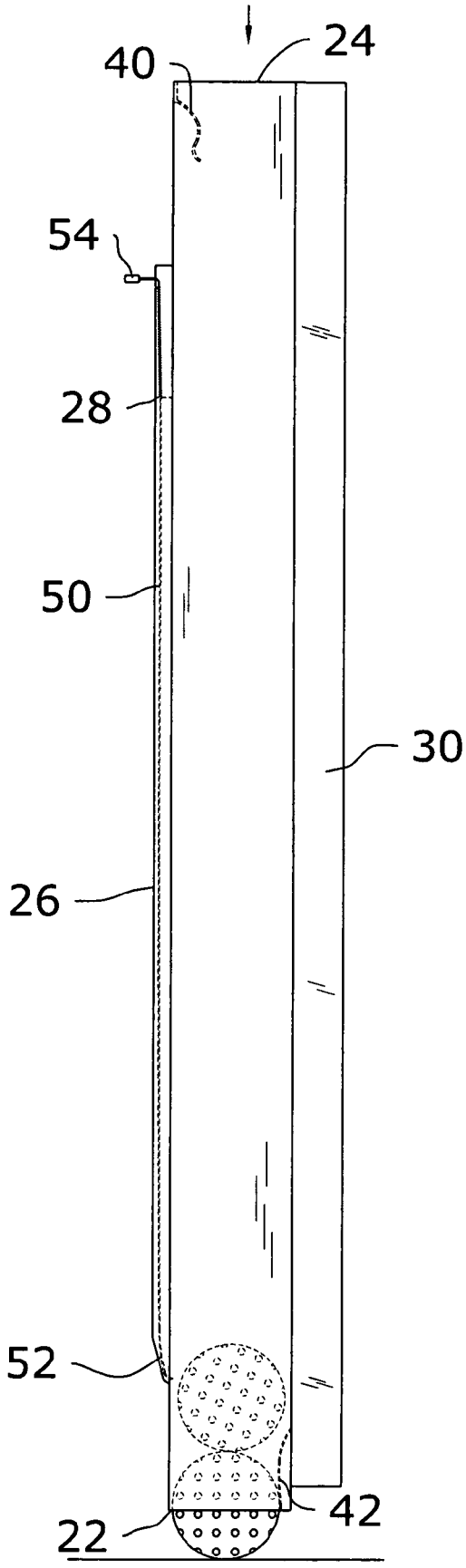
FIG. 8 is a side view of the present invention with the second golf ball pushing the first golf ball into the tube.

If the lower opening 22 is to be used to load the reservoir 21 or to retrieve golf balls 12, the user would first position the lower opening 22 directly above a golf ball 12 to be retrieved as shown in FIG. 5 of the drawings. The user then would lower the tube 20 upon the golf ball 12 wherein the golf ball 12 forces the retrieval member 42 to flex toward the inner wall of the tube 20 as shown in FIG. 6 of the drawings. The user continues this process with additional golf balls 12 wherein the next golf ball 12 inserted into the lower opening 22 forces the previous golf balls 12 upwardly as shown in FIGS. 7 and 8 of the drawings.

I. Operation of Invention—Dispensing Golf Balls

Figure 9:
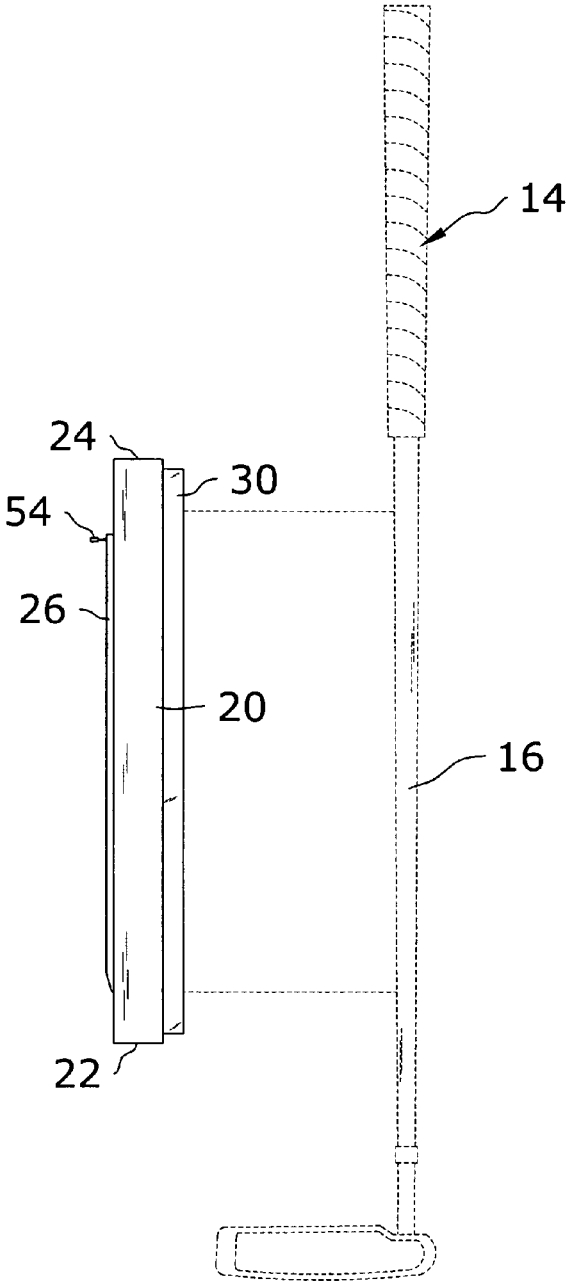
FIG. 9 is an exploded side view of the present invention with respect to a golf club.
Figure 10:
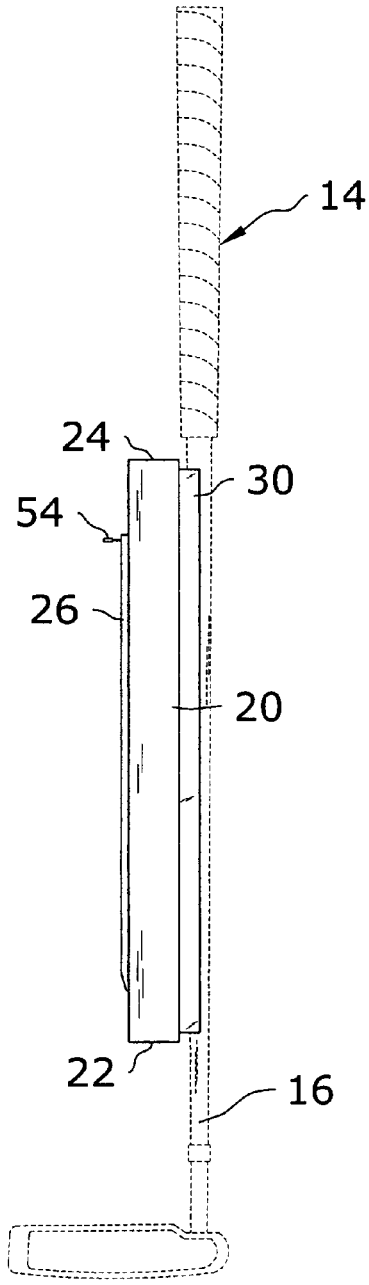
FIG. 10 is a side view of the present invention attached to a shaft of a golf club.

After the reservoir 21 is filled with golf balls 12, the user then attaches the present invention to the shaft 16 of a putter 14 as shown in FIGS. 9 and 10 of the drawings. The clamp 30 removably and catchably receives the shaft 16 of the putter 14 in various locations.

When the user is properly positioned and prepared to make a practice putt, the handle portion 54 of the ejector member 50 is manipulated to cause the ejector member 50 to extend downwardly as shown in FIG. 3 of the drawings. The ejector member 50 is caused to be further extended downwardly whereby the extended portion 52 of the ejector member 50 extends through the side opening 27 within the tube 20 and thereafter engaging an upper portion of the lowest golf ball 12 thereby forcing the lowest golf ball 12 out through the lower opening 22 as shown in FIG. 4 of the drawings.

As the lowest golf ball 12 is being forced out through the lower opening 22 within the tube 20, the extended portion 52 and the retrieval member 42 prevent the next golf ball 12 from exiting the lower opening 22. The user then releases the handle portion 54 and the bias member 60 forces the ejector member 50 back to its original position as shown in FIG. 2 of the drawings.

As additional golf balls 12 are required the same process is then followed. When the user is ready to retrieve the golf balls 12, the user simply removes the present invention from the putter 14 and repeats the retrieval process as described above.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A golf ball dispensing and retrieving system, comprising:

an elongated tube having a lower opening and a reservoir capable of receiving a plurality of golf balls;

a clamp extending from a side of said tube for removably attaching to a shaft of a putter;

a retrieval member attached within said tube near said lower opening; and an ejector member movably positioned within said tube for ejecting a lower golf ball from said lower opening;

wherein said ejector member selectively engages said lower golf ball and applies a downward force upon said lower golf ball to extend said lower golf ball through said lower opening.

2. The golf ball dispensing and retrieving system of claim 1, including a bias member attached to said ejector member for applying a return force to said ejector member.

3. The golf ball dispensing and retrieving system of claim 2, wherein said bias member is a compression spring.

4. The golf ball dispensing and retrieving system of claim 1, including an elongated guide member having a tubular structure attached to a side of said elongated tube for movably receiving said ejector member and a side opening within said tube for receiving a lower portion of said ejector member.

5. The golf ball dispensing and retrieving system of claim 4, wherein said ejector member is comprised of an elongated structure having an extended portion that extends through said side opening at an angle with respect to a longitudinal axis of said tube.

6. The golf ball dispensing and retrieving system of claim 5, wherein said ejector member includes a handle portion opposite of said extended portion.

7. The golf ball dispensing and retrieving system of claim 6, wherein said handle portion extends through a slot within said guide member.

8. The golf ball dispensing and retrieving system of claim 7, wherein said side opening is positioned above said lower opening a distance sufficient for a distal end of said ejector member to engage an upper portion of said lower golf ball within said tube.

9. The golf ball dispensing and retrieving system of claim 4, including a partition member within said guide member wherein said ejector member slidably extends through said partition member and wherein a bias member engages said partition member.

10. The golf ball dispensing and retrieving system of claim 1, wherein said clamp is comprised of an elongated structure formed to snugly receive a shaft of a golf club.

11. The golf ball dispensing and retrieving system of claim 10, including a magnetic strip attached within said clamp.

12. The golf ball dispensing and retrieving system of claim 1, wherein said tube includes an upper opening.

13. The golf ball dispensing and retrieving system of claim 12, including a stopper member within an upper portion of said tube for preventing said plurality of golf balls from escaping through said upper opening.

14. The golf ball dispensing and retrieving system of claim 13, wherein said stopper member extends downwardly into said reservoir of said tube.

15. A golf ball dispensing and retrieving system, comprising:

an elongated tube having a lower opening, an upper opening and a reservoir capable of receiving a plurality of golf balls;

a stopper member within an upper portion of said tube for preventing golf balls from escaping through said upper opening, wherein said stopper member extends downwardly into said reservoir of said tube;

a clamp extending from a side of said tube for removably attaching to a shaft of a putter, wherein said clamp is comprised of an elongated structure formed to snugly receive a shaft of a golf club;

a retrieval member attached within said tube near said lower opening;

an elongated guide member having a tubular structure attached to a side of said elongated tube;

a side opening within a lower portion of said tube;

an ejector member movably positioned within said elongated guide member;

wherein said ejector member is comprised of an elongated structure having an extended portion that extends through said side opening at an angle with respect to a longitudinal axis of said tube for ejecting a lower golf ball from said lower opening, and a handle portion opposite of said extended portion for allowing a user to manually manipulate said ejector member;

wherein said side opening is positioned above said lower opening a distance sufficient for a distal end of said ejector member to engage an upper portion of said lower golf ball within said tube; and a bias member attached to said ejector member for applying a return force to said ejector member;

wherein said extended portion of said ejector member selectively engages said lower golf ball and applies a downward force upon said lower golf ball to extend said lower golf ball through said lower opening.

16. The golf ball dispensing and retrieving system of claim 15, wherein said bias member is a compression spring.

17. The golf ball dispensing and retrieving system of claim 15, wherein said handle portion extends through a slot within said guide member.

18. The golf ball dispensing and retrieving system of claim 15, including a partition member within said guide member wherein said ejector member slidably extends through said partition member and wherein said bias member engages said partition member.

19. The golf ball dispensing and retrieving system of claim 15, including a magnetic strip attached within said clamp.

20. A golf ball dispensing and retrieving system, comprising:

an elongated tube having a lower opening and a reservoir capable of receiving a plurality of golf balls;

a clamp extending from a side of said tube for removably attaching to a shaft of a putter;

a retrieval member attached within said tube near said lower opening;

an ejector member movably positioned within said tube for ejecting a lower golf ball from said lower opening;

an elongated guide member having a tubular structure attached to a side of said elongated tube for movably receiving said ejector member and a side opening within said tube for receiving a lower portion of said ejector member;

a bias member attached to said ejector member for applying a return force to said ejector member; and a partition member within said elongated guide member wherein said ejector member slidably extends through said partition member and wherein said bias member engages said partition member.

* * * * *